US006168031B1

(12) United States Patent
Schmidt

(10) Patent No.: US 6,168,031 B1
(45) Date of Patent: Jan. 2, 2001

(54) HANGING FILE SUPPORT APPARATUS

(75) Inventor: Herbert Schmidt, High Point, NC (US)

(73) Assignee: Fulterer USA, Inc., High Point, NC (US)

( * ) Notice: Under 35 U.S.C. 154(b), the term of this patent shall be extended for 0 days.

(21) Appl. No.: 09/204,931

(22) Filed: Dec. 3, 1998

(51) Int. Cl.[7] ..... A47F 5/14
(52) U.S. Cl. ..... 211/46; 211/182; 403/217
(58) Field of Search ..... 211/46, 189, 181.1, 211/182; 312/183, 184; 403/170, 217, 218, 205, 231; 446/114, 126

(56) References Cited

U.S. PATENT DOCUMENTS

| | | | | |
|---|---|---|---|---|
| D. 384,988 | * | 10/1997 | Schmidt | 403/217 |
| 2,571,337 | * | 10/1951 | Burnham | 211/218 |
| 3,138,398 | * | 6/1964 | Silverman | 403/217 |
| 3,263,692 | * | 8/1966 | Questi et al. | 211/182 X |
| 3,913,995 | | 10/1975 | Malcik et al. | 312/183 |
| 4,030,610 | * | 6/1977 | Alexander | 211/182 |
| 4,091,933 | | 5/1978 | Alexander | 211/204 |
| 4,219,247 | | 8/1980 | Litchfield et al. | 312/184 |
| 4,344,661 | | 8/1982 | Gotberg | 312/330 |
| 4,427,379 | * | 1/1984 | Duran et al. | 211/182 |
| 4,475,657 | | 10/1984 | Albery | 211/46 |
| 4,765,490 | * | 8/1988 | Hanson | 211/46 |
| 4,869,380 | * | 9/1989 | Metcalfe et al. | 211/189 |
| 4,869,653 | | 9/1989 | Willer | 312/184 |
| 4,887,873 | | 12/1989 | Goedken et al. | 312/184 |
| 4,988,006 | | 1/1991 | Lundin | 211/46 |
| 5,094,562 | * | 3/1992 | Anderson | 403/218 |
| 5,257,794 | * | 11/1993 | Nakamura | 211/182 X |
| 5,358,126 | | 10/1994 | Jones et al. | 211/46 |
| 5,407,262 | * | 4/1995 | Christian et al. | 211/46 X |
| 5,430,989 | * | 7/1995 | Jones | 403/217 |
| 5,515,980 | * | 5/1996 | Fotioo | 211/46 |
| 5,549,408 | * | 8/1996 | Lo | 403/218 |
| 5,671,852 | * | 9/1997 | Maharg | 211/189 |
| 5,743,412 | * | 4/1998 | Noble | 211/182 |

* cited by examiner

*Primary Examiner*—Daniel P. Stodola
*Assistant Examiner*—Jennifer E. Novosad
(74) *Attorney, Agent, or Firm*—Rhodes & Mason, PLLC

(57) ABSTRACT

A hanging file support apparatus having a rectangular top for receiving hanging file folders. The top contains circular support rods of identical cross section fitted into modular cornerpieces having three orthogonal extensions for receiving the rods. A pair of clip-on dividers with a rod extending between them may be attached to the top. The top may be attached to the top edge or inside of a drawer or other workspace through holes in the cornerpieces. The top may also be supported by vertical support rods that are received by the cornerpieces. The vertical rods may be mounted into holes in a drawer, shelf or other workspace. Alternatively, the vertical rods may be mounted into a base comprised of cornerpieces and rods.

25 Claims, 5 Drawing Sheets

HANGING FILE SUPPORT APPARATUS

BACKGROUND OF THE INVENTION

The invention provides an improved apparatus for supporting hanging file folders. Hanging file folders are well known in the art. Various structures have been used to support hanging file folders in a drawer or other workspace. For example, in Jones et al, U.S. Pat. No. 5,358,126, side rails (63, 65) are connected to U-shaped end frame members having slotted ends (67*a, b, c, d*) with corner caps (69*a, b, c, d*) and cross braced by rigid elements in the file folders (23). In Albery, U.S. Pat. No. 4,457,657, support rails (64, 66), cross braces (68, 70), and legs (72) are connected to corner units (34), which consist of folding planar elements connected with a flexible web. Both of these configurations are designed to rest inside a drawer. In Goedkin et al, U.S. Pat. No. 4,887,873, a pair of hanging rails (14*a, b*) is attached to the front and back walls of a drawer (11*a*).

These prior designs are disadvantageous because they are not adaptable to many different configurations using the same basic parts. These prior designs also lack an easy to use clip-on divider in such a modular system.

The present invention overcomes this disadvantage because it employs identical cornerpieces, support members of uniform size and shape, clip-on dividers, and optional attachment to the drawer or workspace. The modular nature of the design facilitates the use of the product in ready to assemble furniture and in aftermarket applications with only a minimal number of different parts, or SKU's (Stock Keeping Units).

SUMMARY OF THE INVENTION

A hanging file support apparatus has a modular cornerpiece and circular support rods of identical cross section. The rods are fitted into the cornerpieces to form a rectangular top for receiving hanging file folders. A pair of clip-on dividers with a rod extending between them may be attached to the top. The top may be attached to the top edge or inside of a drawer or other workspace through holes in the cornerpieces. The top may also be supported by vertical support rods that are received by the cornerpieces. The vertical rods may be mounted into holes in the top of a drawer, shelf or other workspace. Alternatively, the rods may be mounted into a base comprised of cornerpieces and rods.

These and other aspects of the present invention will become apparent to those skilled in the art after reading the following description of the preferred embodiments when considered with the drawings.

BRIEF DESCRIPTION OF THE DRAWINGS

The above and other objects and advantages of the present invention will become apparent from the following detailed description of several preferred embodiments of the invention illustrated in the accompanying drawings, wherein.

DETAILED DESCRIPTION OF THE PREFERRED EMBODIMENTS

Figure 1:
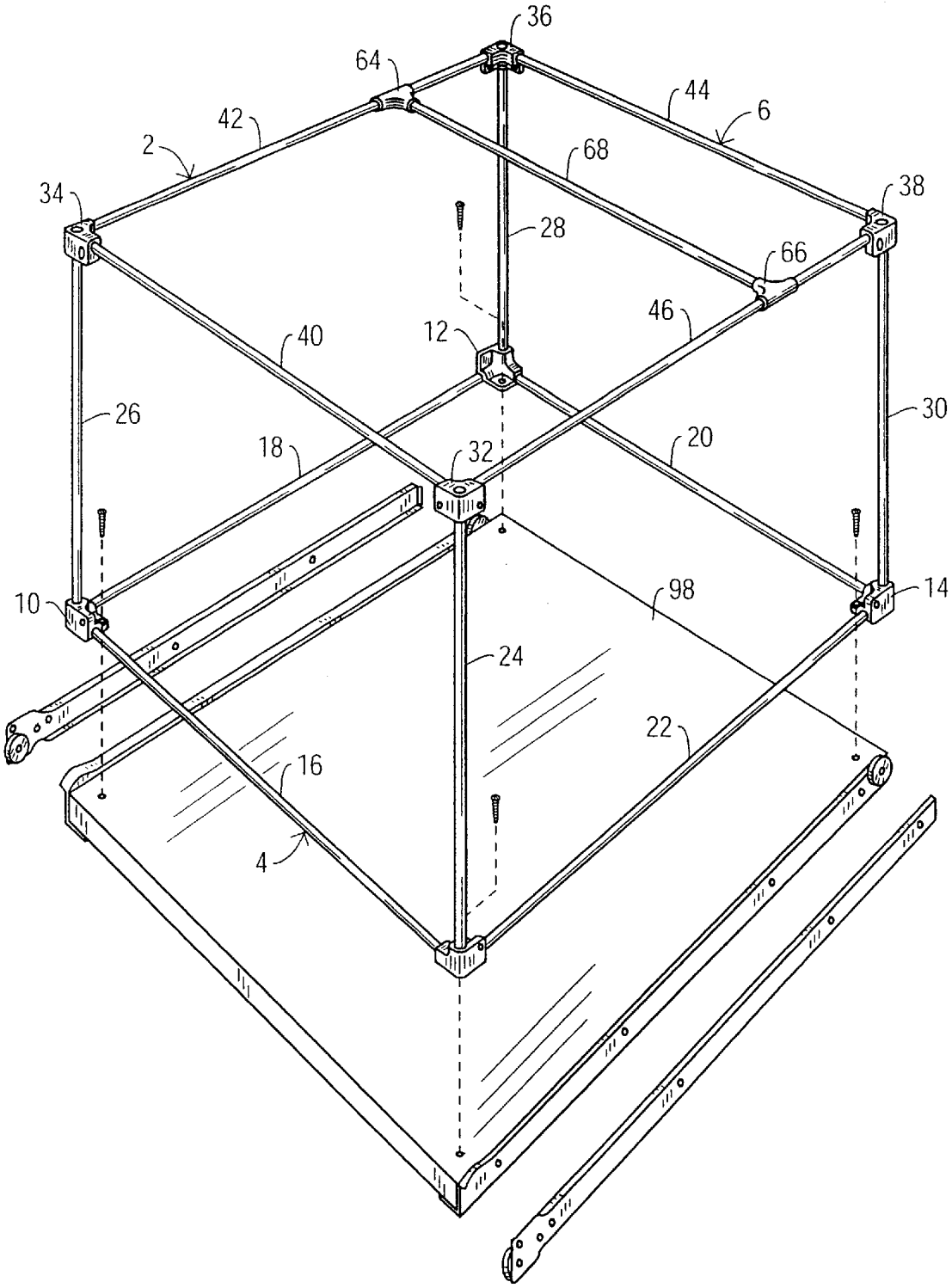
FIG. 1 is a perspective view of a first embodiment of the file support apparatus secured to a sliding shelf.

In the following description, like reference characters designate like or corresponding parts throughout the several figures. It should be understood that the illustrations are for the purpose of describing preferred embodiments of the invention and are not intended to limit the invention thereto.

As seen in FIG. 1, a hanging file support apparatus 2 in accordance with the invention has a rectangular base 4 including four base cornerpieces 8, 10, 12, and 14, and four base rods 16, 18, 20, and 22 extending between the base cornerpieces. Four vertical rods 24, 26, 28, and 30 extend vertically upward from the base cornerpieces and join to a rectangular top 6 including four top cornerpieces 32, 34, 36 and 38, and four top rods 40, 42, 44, and 46 extending between the top cornerpieces. A pair of clip-on divider supports 64, 66 is attached to an opposing pair of top rods 42 and 46 in the top 6, and a divider rod 68 extends between the divider supports. The divider supports have an arcuate section designed to clip onto the rods and an orthogonal extension that contains a hole for receiving the rod 68. Each of the cornerpieces 8, 10, 12, 14, 32, 34, 36, 38 is identical and each of the rods 16, 18, 20, 22, 24, 26, 28, 30, 40, 42, 46 and 48 has an identical circular cross section. The hanging file support apparatus 2 is attached to a sliding drawer 98.

Figure 2:
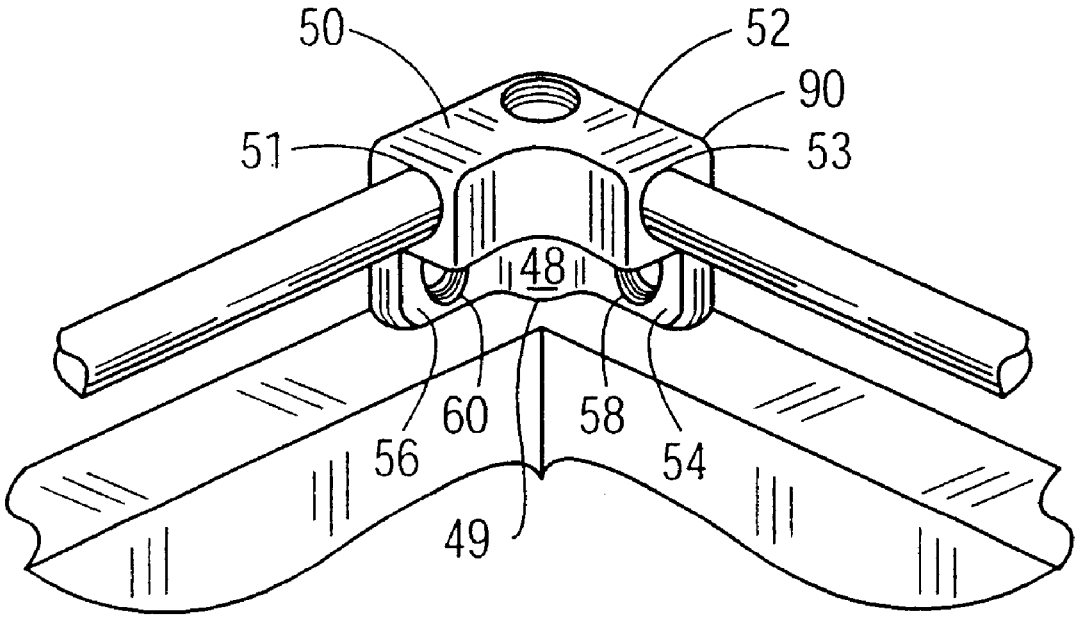
FIG. 2 is a perspective view of the cornerpiece of the invention.

As is best seen in FIG. 2, each cornerpiece includes a body 90 having orthogonal extensions 48, 50, and 52. Each orthogonal extension has a corresponding hole 49, 51, and 53 in its longitudinal axis that receives the rods. The cornerpiece has webs 54, 56 extending between two pairs of the longitudinal extensions and a hole 58,60 through each web. Each of the holes 49, 51, 53 in the orthogonal extensions has the same diameter, which is sized to receive the rods. The hole diameter is selected to make a secure press-fit with the rod. In addition, the hole 53 that runs parallel to the two webs has a reduced diameter for approximately half of its depth. This reduced diameter portion of the hole 53 is approximately the same diameter as the holes 58, 60 in the webs and is designed to receive a screw, nail or other fastening device. The cornerpiece is preferably injection molded using a thermoplastic material such as polypropylene.

Figure 3:
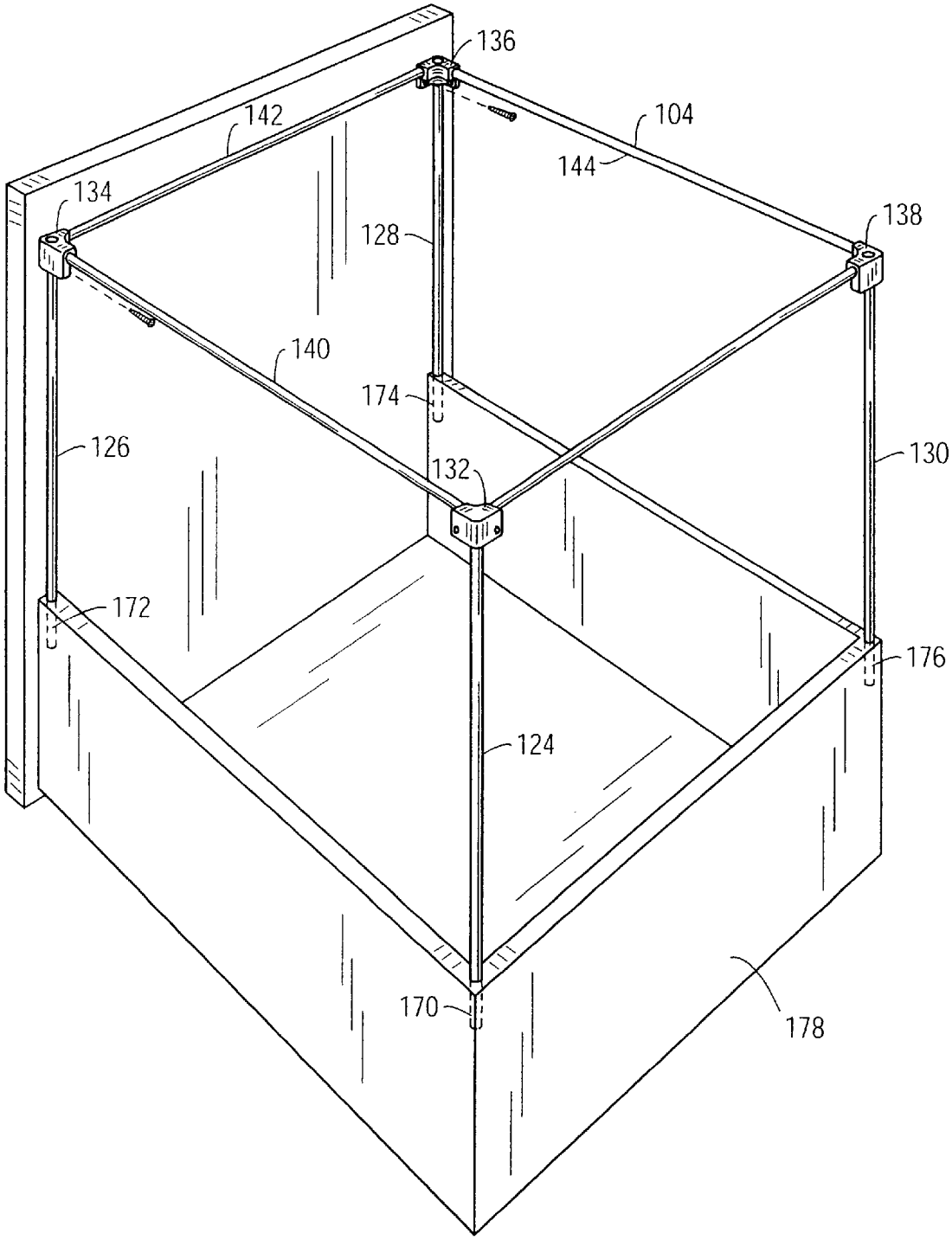
FIG. 3 is a perspective view of a second embodiment of the file support apparatus mounted in a box drawer.

As is best seen in FIG. 3, another embodiment of the invention has a rectangular top 104 including four top cornerpieces 132, 134, 136 and 138 and four top rods 140, 142, 144, and 146 extending between the top cornerpieces. It also has four vertical rods 124, 126, 128, and 130 extending vertically downwardly from the top cornerpieces. The vertical rods are mounted in holes 170, 172, 174, and 176 in sidewalls of a box drawer 178 or other work surface. For additional stability, the top cornerpieces 134, 136 may also be fastened to the inside face of front wall 179 of the drawer 178 with screws, nails or other fasteners. This embodiment is advantageous because it permits installation of a stable file folder support in a box drawer having a full size front wall, but reduced height walls in the side and back. The clip-on divider supports may also be used with this embodiment.

Figure 4:
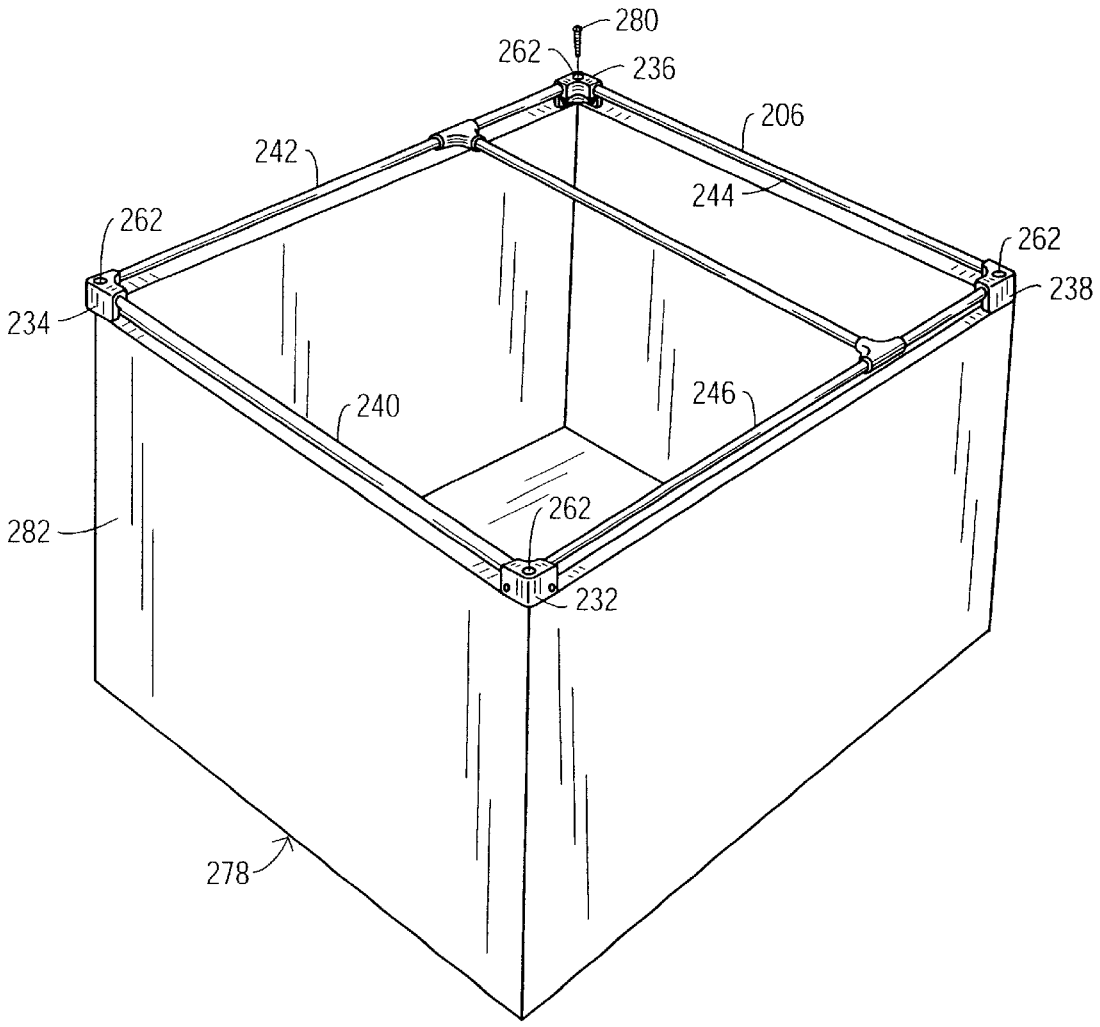
FIG. 4 is a perspective view of a third embodiment of the file support apparatus secured to the top edge of a drawer.

FIG. 4 illustrates another embodiment in which the rectangular top 206 contains four top cornerpieces 232, 234, 236, 238 and four top rods 240, 242, 244, 246 extending between the top cornerpieces. For mounting on the top edge of a drawer 278 or other workspace, the cornerpieces each have a hole 262 extending through most of the height of one of the orthogonal extensions. In the preferred embodiment of the cornerpiece, the hole does not extend the entire height of the extension, but instead remains closed at one end. In FIG. 4, the closed end of hole 262 is at the top of the cornerpiece. In addition, the hole has a reduced diameter (not shown) near the closed end. The closed end is relatively thin, and is readily penetrated by a fastener 280. This design allows the cornerpiece to have the appearance of three identical holes for receiving rods, but permits the optional creation of a fourth hole of slightly smaller diameter for use with a fastener in the configuration of FIG. 4. In this configuration, the top 6 may be fastened to the top edge of a side wall 282 of a full height drawer.

Figure 5:
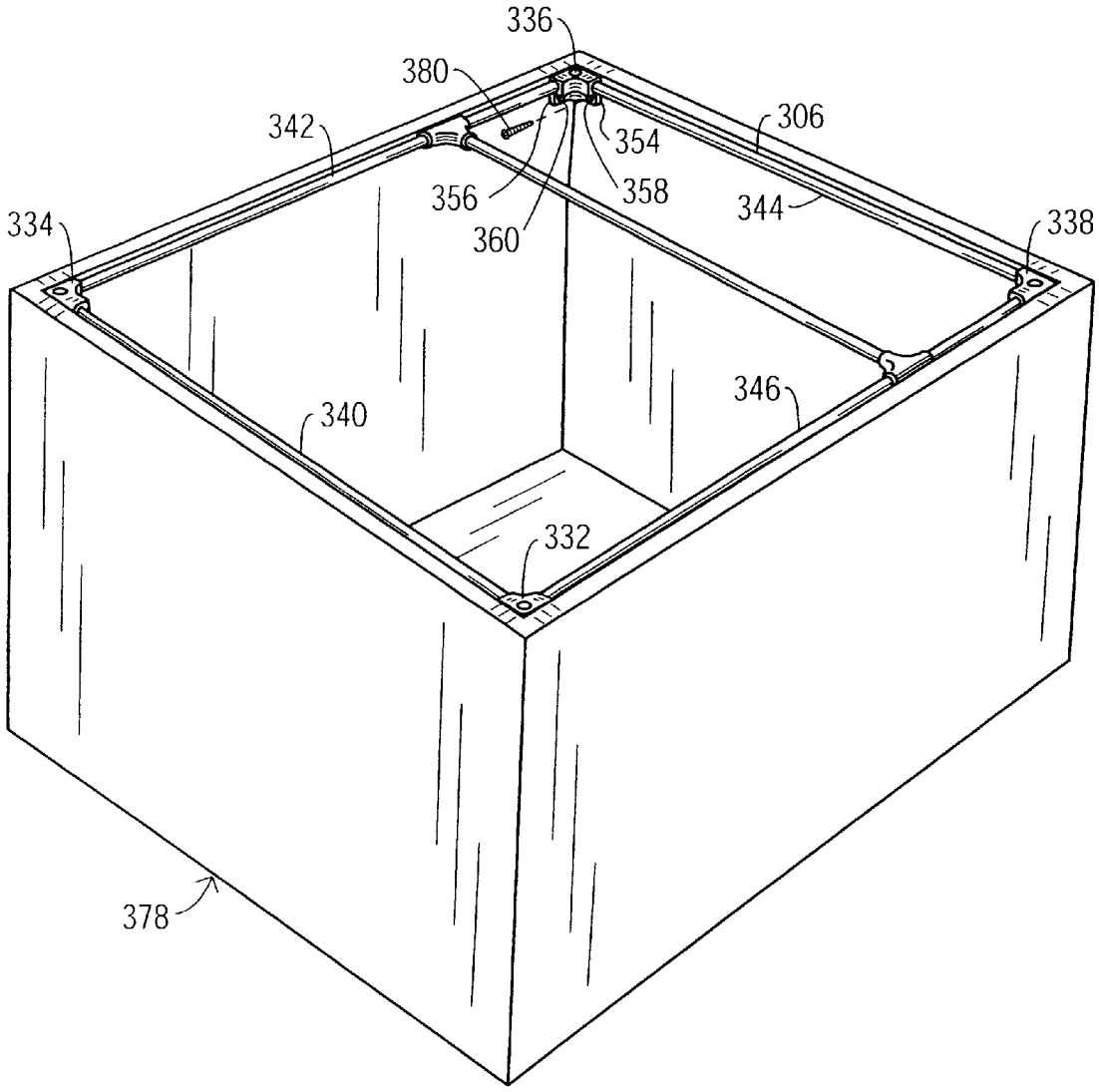
FIG. 5 is a perspective view of the third embodiment of the file support apparatus secured to the inside wall of a drawer.

FIG. 5 shows the rectangular top 306 composed of four top cornerpieces 332, 334, 336, 338 and four top rods 340, 342, 344, 346 extending between the top cornerpieces. The top cornerpieces are secured to the inside of a drawer 378 or other workspace by screws, nails or other fasteners. The fasteners 380 are passed through one or both of the holes 358, 360 in the webs 354, 356.

As is apparent from the various configuration shown, the modular design permits hanging file folder supports to be placed in a variety of structures. The configuration of FIG. 1 can be placed in a full size drawer, a half drawer, a fixed shelf or a sliding shelf. It can be unattached or secured by fasteners, as desired, to the top and/or bottom of the support structure. The configuration of FIG. 3 may be placed over any workspace that has appropriate holes 170, 172, 174, 176 to receive the rods 124, 126, 128, 130. In addition to the mounting holes in the base, the apparatus may optionally be secured to the support structure by fasteners placed through the webs in any of the cornerpieces that adjoin a part of the support structure. The embodiment of FIGS. 4 and 5, having only the top, may be secured to the top or side of a drawer or workspace with fasteners through the webs or through the orthogonal extension having a reduced diameter hole.

The foregoing embodiments show that the invention provides tremendous flexibility for the furniture manufacturer or aftermarket supplier. The only SKU's that need to be stocked to create all of these embodiments are the modular cornerpiece, the clip-on divider, a single diameter of support rod, and appropriate fasteners. The hanging file support apparatus may be installed in box drawers, full height drawers, fixed or sliding shelves, and other suitable workspaces.

It will be understood that the above described embodiments are illustrative and are not intended to be limiting, as can be seen from the following claims. Other variations will be apparent to those of ordinary skill in the art and are deemed encompassed within the scope of the invention.

Certain modifications and improvements will occur to those skilled in the art upon reading the foregoing description. It should be understood that all such modifications and improvements have been omitted for the sake of conciseness and readability, but are properly within the scope of the following claims.

I claim:

1. A hanging file support system comprising:

a rectangular base including four base cornerpieces and four base rods extending between said base cornerpieces, the cornerpieces having horizontal orthogonal extensions that receive the base rods and a web extending between the horizontal orthogonal extensions, the web being generally coplanar with the horizontal extensions and having a hole therethrough, four vertical rods extending vertically upward from said base cornerpieces, a rectangular top including four top cornerpieces and four top rods extending between said top cornerpieces, each said top cornerpiece receiving one of said four vertical rods, and a flat surface supporting said rectangular base joined to the base cornerpieces through the holes in the base cornerpiece webs, wherein said base rods, said vertical rods and said top rods have identical cross sections.

2. A hanging file support system as claimed in claim 1 wherein said base cornerpieces and said top cornerpieces are identical to one another.

3. A hanging file support system as claimed in claim 1 wherein said base rods, said vertical rods and said top rods have identical cross sections.

4. A hanging file support system as claimed in claim 3 wherein said base rods, said vertical rods and said top rods have circular cross sections.

5. A hanging file support system as claimed in claim 1, further comprising a pair of clip-on divider supports attached to an opposing pair of said top rods extending between said top cornerpieces, and a divider rod extending between said clip-on divider supports.

6. A hanging file support system as claimed in claim 1 wherein said flat surface is the bottom of a drawer.

7. A hanging file support system as claimed in claim 6 wherein said rectangular base is secured to said drawer.

8. A hanging file support system as claimed in claim 1 wherein said flat surface is a shelf.

9. A hanging file support system comprising:

a rectangular top including four top cornerpieces and four top rods extending between said top cornerpieces, and four vertical rods extending vertically downward from said top cornerpieces and a drawer having mounting holes therein to receive said vertical rods, said vertical rods being mounted in said mounting holes in the drawer, wherein said vertical rods and said top rods have identical cross sections.

10. A hanging file support system as claimed in claim 9 wherein said top cornerpieces are identical to one another.

11. A hanging file support system as claimed in claim 9 wherein said top cornerpieces have orthogonal extensions that receive said top rods and said vertical rods and a web extending between, and generally coplanar with, two of said orthogonal extensions, said web having a hole therethrough.

12. A hanging file support system as claimed in claim 9, further comprising a pair of clip-on divider supports attached to an opposing pair of said top rods extending between said top cornerpieces, and a divider rod extending between said clip-on divider supports.

13. A hanging file support system comprising:

a rectangular top including four top cornerpieces and four top rods extending between said top cornerpieces, said top cornerpieces each having a hole extending vertically through most of the height of said top cornerpieces, a workspace having a vertical wall with a top edge, and a fastening device extending through one or more of said top cornerpieces to attach said rectangular top to said top edge of said vertical wall of said workspace.

14. A hanging file support system as claimed in claim 13 wherein said top cornerpieces are identical to one another.

15. A hanging file support system as claimed in claim 13 wherein said workspace is a drawer.

16. A hanging file support system comprising:

a rectangular top including four top cornerpieces and four top rods extending between said top cornerpieces, wherein said top rods have identical cross sections, said top cornerpieces each having orthogonal extensions with an enclosed, circular socket that receive said top rods and an additional extension orthogonal to said orthogonal extensions, and a web extending between one of said orthogonal extensions and said additional extension, the web being generally coplanar with the one orthogonal extension and said additional extension, said web having a hole therethrough, a workspace having a vertical wall, and a fastening device extending through said hole to attach said rectangular top to said wall of said workspace.

17. A hanging file support system as claimed in claim 16 wherein said workspace is a drawer.

18. A cornerpiece for a hanging file support apparatus comprising:

a body having first, second and third orthogonal extensions, each of the orthogonal extensions having an enclosed, circular socket for receiving a rod, and a web extending between, and generally coplanar with, said first and said second extensions.

19. A cornerpiece for a hanging file support apparatus as claimed in claim 18 wherein said web has a hole therethrough.

20. A cornerpiece for a hanging file support apparatus as claimed in claim 18 wherein each of the sockets in the orthogonal extensions has the same diameter.

21. A cornerpiece for a hanging file support apparatus as claimed in claim 18 having a second web extending between, and generally coplanar with, said second and said third extensions.

22. A cornerpiece for a hanging file support apparatus as claimed in claim 18 wherein said cornerpiece is injection molded.

23. A cornerpiece for a hanging file support apparatus comprising:

a body having first, second and third orthogonal extensions for receiving rods, and a web extending between the first and second orthogonal extensions and being generally coplanar with the first and second orthogonal extensions, the web having a hole therethrough, wherein each of the orthogonal extensions has a socket in its longitudinal axis, and each socket has the same diameter, and one of said sockets is closed at one end and has a smaller diameter near said closed end than the diameter at the open end.

24. A cornerpiece for a hanging file support apparatus comprising:

a body having first, second and third orthogonal extensions having enclosed sockets for receiving rods, and a first web extending between the first and second orthogonal extensions and being generally coplanar with the first and second orthogonal extensions, and a second web extending between the second and third orthogonal extensions and being generally coplanar with the second and third orthogonal extensions, wherein said web and said second web each have a hole therethrough.

25. A hanging file support system comprising:

a rectangular top including four top cornerpieces and four top rods extending between the top cornerpieces, four vertical rods extending vertically downward from the top cornerpieces, and a supporting surface having mounting holes therein to receive the vertical rods, the vertical rods being mounted in the mounting holes in the supporting surface wherein the supporting surface is a drawer and at least one of said top cornerpieces is secured to the drawer.

* * * * *